US011932482B1

(12) United States Patent
Strunk et al.

(10) Patent No.: US 11,932,482 B1
(45) Date of Patent: Mar. 19, 2024

(54) FLEXIBLE BULK CONTAINER

(71) Applicant: MHF Packaging Solutions, LLC, Salt Lake City, UT (US)

(72) Inventors: Rusty D. Strunk, Pioneer, TN (US); Thomas E. Brandon, Crowley, LA (US)

(73) Assignee: MHF Packaging Solutions, LLC, Salt Lake City, UT (US)

( * ) Notice: Subject to any disclaimer, the term of this patent is extended or adjusted under 35 U.S.C. 154(b) by 0 days.

(21) Appl. No.: 17/661,043

(22) Filed: Apr. 27, 2022

Related U.S. Application Data

(60) Provisional application No. 63/202,483, filed on Jun. 14, 2021.

(51) Int. Cl.
*B65D 88/16* (2006.01)
*B65D 88/20* (2006.01)

(52) U.S. Cl.
CPC ..... *B65D 88/1681* (2013.01); *B65D 88/1668* (2013.01); *B65D 88/20* (2013.01)

(58) Field of Classification Search
CPC . B65D 88/10; B65D 88/1681; B65D 88/1668
USPC ..... 383/24
See application file for complete search history.

(56) References Cited

U.S. PATENT DOCUMENTS 3,827,471 A * 8/1974 Gregory ..... B65D 88/1612 383/41
3,893,595 A 7/1975 Khanna et al.
4,573,204 A 2/1986 Polett
4,781,473 A 11/1988 LaFleur
5,110,005 A 5/1992 Schilling
5,393,117 A 2/1995 Beale
6,079,934 A 6/2000 Beale
6,142,727 A 11/2000 Beale
6,155,772 A 12/2000 Beale
6,220,755 B1 * 4/2001 Brown ..... B65D 88/1625 383/119
6,244,443 B1 * 6/2001 Nickell ..... B65D 90/046 220/9.4
6,585,414 B2 * 7/2003 Peska ..... B65D 31/12 190/110

(Continued)

FOREIGN PATENT DOCUMENTS

DE 20 2004 014 966 U1 1/2005
JP 2004-345710 A 12/2004

OTHER PUBLICATIONS

LiftPac Self-Standing UN Rated Bulk Bag, Pactec, Inc., 2020 (4 pp.).

(Continued)

*Primary Examiner* — Peter N Helvey
(74) *Attorney, Agent, or Firm* — FisherBroyles, LLP

(57) ABSTRACT

Various embodiments of a flexible bulk container are disclosed having a number of innovative features. In one embodiment, the flexible bulk container includes an enclosure defining an interior volume in which a support sling is located. The support sling helps prevent the shape of the container from deforming as it is filled with bulk material. In another embodiment, the flexible bulk container includes an opening in the top through which it can be filled with material. A cord is coupled to the top around the opening and can operate as a drawstring to close the opening.

20 Claims, 5 Drawing Sheets

(56) References Cited

U.S. PATENT DOCUMENTS

| | | | | |
|---|---|---|---|---|
| 6,834,995 | B1 | 12/2004 | Stevens | |
| 7,073,676 | B1 | 7/2006 | Town | |
| 7,845,511 | B1 | 12/2010 | Strickland et al. | |
| 8,191,722 | B1 | 6/2012 | Town | |
| 8,499,953 | B1 | 8/2013 | Town | |
| 8,562,212 | B1 | 10/2013 | Strickland et al. | |
| 8,602,243 | B2 * | 12/2013 | Hunter | B65D 25/06 220/651 |
| 8,777,034 | B1 | 7/2014 | Town | |
| 8,894,281 | B2 | 11/2014 | Town et al. | |
| 8,894,282 | B2 | 11/2014 | Town et al. | |
| 9,056,710 | B1 | 6/2015 | Strickland et al. | |
| 9,365,345 | B2 | 6/2016 | Town et al. | |
| 9,478,322 | B1 | 10/2016 | Schilling et al. | |
| 9,493,299 | B2 | 11/2016 | Town et al. | |
| 9,679,669 | B2 | 6/2017 | Schilling et al. | |
| RE48,199 | E | 9/2020 | Strickland et al. | |
| 10,934,089 | B2 * | 3/2021 | Mullins | B65F 1/0006 |
| 2007/0086681 | A1 * | 4/2007 | Richardson, Jr. | B65D 88/62 383/33 |
| 2015/0203288 | A1 * | 7/2015 | Hunter | B65D 88/1681 112/475.08 |
| 2020/0118700 | A1 | 4/2020 | Schilling et al. | |

OTHER PUBLICATIONS

Pactec Integral in Alaskan Environmental Restoration, Pactec, Inc., date unknown (see "Date Information" section below for more information) (1 p.).

PacTec's LiftPac IP-1 and IP-2 Flexible Container YouTube video, PacTec, Inc., Apr. 15, 2019, video available at https://www.youtube.com/watch?v=T-5-6_9OUUI (transcript and screenshots from video included in two separate files of 108 pp. each for a total of 216 pp.).

UN Certified IP-1 LiftPac, Pactec, Inc, 2020 (3 pp.).

* cited by examiner

FLEXIBLE BULK CONTAINER

TECHNICAL FIELD

This relates to bulk containers used to store and/or transport material, and particularly to flexible bulk containers having an interior volume configured to receive the material.

BACKGROUND

Flexible bulk containers are industrial containers made of flexible fabric that is configured for storing and transporting bulk materials such as dry, flowable products including things such as sand, fertilizer, granules of plastic, and the like. The containers provide a number of advantages and can be used for a wide variety of purposes. For example, the flexible nature of the containers makes it easy to transport them empty to the desired location for use. In contrast, hard sided containers take much more space and are heavier to transport.

Conventional flexible bulk containers suffer from a number of disadvantages. One disadvantage is that the containers tend to become misshapen when filled with heavy flowable materials such as soil and the like. For example, an opening in the top of a rectangular container may bow or stretch outward when loaded until it is no longer rectangular and, instead, becomes more of an oval or round shape.

Another problem with conventional flexible bulk containers is that they can be difficult to close when filled with material. For example, containers having a zipper closure in the top may be difficult to close due to excess material if the container is even slightly overfilled. Also, as the sides bow outward, there may not be enough fabric to close the zipper closure.

GENERAL DESCRIPTION

A number of embodiments of a flexible bulk container are described having a variety of improvements. In some embodiments, the flexible bulk container includes a support sling positioned in an interior volume of the bulk container. The support sling is attached to opposing sides of the bulk container near an opening in the top. The support sling uses the weight of the material loaded into the bulk container to maintain the shape of the opening and/or the overall shape of the bulk container.

In some embodiments, the flexible bulk container includes a cord coupled to the top around the opening that can be used as a drawstring to close the opening. This arrangement makes it easy to close the opening in situations where the bulk container is overfilled or the top opening is stretched open by the material.

In some embodiments, the flexible bulk container is a self standing bulk container. Rigid panels can be attached to or incorporated into the sides and/or bottom to make the bulk container self standing. In other embodiments, the flexible bulk container is non self standing. A rigid frame can be used to support the bulk container as it is loaded with material.

In some embodiments, the opening in the top of the flexible bulk container is the only opening in the bulk container. For example, there may be no other openings in the sides and/or the bottom. In some embodiments, the opening in the top is sized to fold down over the exterior of the sides of the bulk container to facilitate loading. In this situation, the opening is larger than the footprint of the bulk container to allow it to fold down over the sides.

In some embodiments, the flexible bulk container includes a number of lifting straps coupled to the bulk container. The lifting straps can be used by equipment to lift and move the flexible bulk container as needed. In some embodiments, the lifting straps extend underneath the bulk container. For example, each lifting strap extends down from the top along the exterior of one side, across the bottom, and up along the opposite side to the top. The lifting straps may be positioned on opposing sides of the bulk container. In some embodiments, the bulk container has a rectangular shape and includes at least one lifting strap positioned on one set of opposing sides and at least one lifting strap positioned on another set of opposing sides. In some embodiments, the lifting straps form a lifting sling that can be used to lift the flexible bulk container.

The flexible bulk container is generally sized to carry bulk materials. In that context, it can have any suitable size. In some embodiments, the bulk container is configured to hold at least 1 cubic yard of material. The bulk container can also be used to carry a variety of different materials including hazardous materials, hazardous waste, radioactive material, and/or radioactive waste. The bulk container can also be used as an overpack for large items having irregular shapes or sizes.

The flexible bulk container can provide a number of advantages. For example, it is lightweight, versatile, compact, collapsible, and easy to assemble. These features make it easy to ship and store. It can also provide a self-contained unit for holding a variety of bulk materials.

In some embodiments, the flexible bulk container includes: an enclosure formed by a flexible fabric and defining an interior volume configured to receive material, the enclosure including: a top; a bottom positioned opposite the top; and one or more sides extending vertically between the top and the bottom, the one or more sides including a first side positioned opposite a second side; a support sling positioned in the enclosure, the support sling including: a first end coupled to the first side of the enclosure at or adjacent to the top of the enclosure; a second end positioned opposite the first end, the second end being coupled to the second side of the enclosure at or adjacent to the top of the enclosure; and a middle section hanging downward in the interior volume.

In some embodiments, the flexible bulk container includes an opening in the top of the enclosure. In some embodiments, the flexible bulk container includes one or more rigid panels coupled to the one or more side walls to facilitate holding the enclosure open in a self-standing configuration. In some embodiments, the first end and the second end of the support sling are coupled to the first side and the second side of the enclosure at a location above the bottom a distance that is at least 60% of the height of the first side and the second side, respectively. In some embodiments, a first distance along the support sling from a first location where the first end is coupled to the first side to a second location where the second end is coupled to the second side is shorter than a second distance from the first location straight downward to the bottom, across the bottom, and straight upward to the second location. In some embodiments, the flexible bulk container includes a lifting sling formed by lifting straps each of which extends down from the top of the enclosure along one of the one or more sides, across the bottom, and up along another one of the one or more sides to the top.

In some embodiments, the flexible bulk container includes: a top including an opening through which the flexible bulk container can be filled with material; a bottom positioned opposite the top, the bottom being configured to rest on the ground and support the flexible bulk container; one or more sides extending vertically between the top and the bottom; an interior volume defined by the top, the bottom, and the one or more sides, the interior volume being configured to receive and hold the material; and a fabric sheet coupled to opposite sides of the one or more sides at or adjacent to the top of the flexible bulk container, the fabric sheet hanging in the interior volume.

In some embodiments, the opening in the top is the only opening in the flexible bulk container. In some embodiments, the opening is sized to allow the top to fold down over the exterior of the one or more sides. In some embodiments, the flexible bulk container includes a cord coupled to the top around the opening, the cord being configured to close the opening. In some embodiments, the bottom and the one or more sides do not include any openings into the flexible bulk container. In some embodiments, the flexible bulk container is self-standing.

In some embodiments, the flexible bulk container includes: an enclosure formed by a flexible fabric and defining an interior volume configured to receive material, the enclosure including: a top; a bottom positioned opposite the top; and one or more sides extending vertically between the top and the bottom; an opening in the top of the enclosure through which the flexible bulk container can be filled with the material; and a cord coupled to the top around the opening; wherein the opening is the only opening in the flexible bulk container; and wherein the cord operates as a drawstring to close the opening.

In some embodiments, the opening in the top is the only opening in the flexible bulk container. In some embodiments, the cord includes opposite ends each of which extends through a cord fastener configured to hold the cord in a closed position. In some embodiments, the flexible bulk container includes loops attached to the top around an exterior perimeter of the opening, the cord extending through the loops. In some embodiments, the flexible bulk container has a rectangular shape.

In some embodiments, the flexible bulk container includes: a top including an opening through which the flexible bulk container can be filled with material; a bottom positioned opposite the top, the bottom being configured to rest on the ground and support the flexible bulk container; one or more sides extending vertically between the top and the bottom; an interior volume defined by the top, the bottom, and the one or more sides, the interior volume being configured to receive and hold the material; and a cord coupled to the top around the opening; wherein the opening is movable from an open position to a closed position by pulling the cord and contracting the opening; and wherein the opening in the top is the only opening in the flexible bulk container.

In some embodiments, the cord includes opposite ends each of which extends through a cord fastener configured to hold the cord in a closed position. In some embodiments, the flexible bulk container includes loops attached to the top around an exterior perimeter of the opening, the cord extending through the loops.

The general description is provided to give a general introduction to the described subject matter as well as a synopsis of some of the technological improvements and/or advantages it provides. The general description and background are not intended to identify essential aspects of the described subject matter, nor should they be used to constrict or limit the scope of the claims. For example, the scope of the claims should not be limited based on whether the recited subject matter includes any or all aspects noted in the general description and/or addresses any of the issues noted in the background.

DESCRIPTION OF DRAWINGS

The preferred and other embodiments are described in association with the accompanying drawings in which.

DETAILED DESCRIPTION OF EMBODIMENTS

Figure 1:
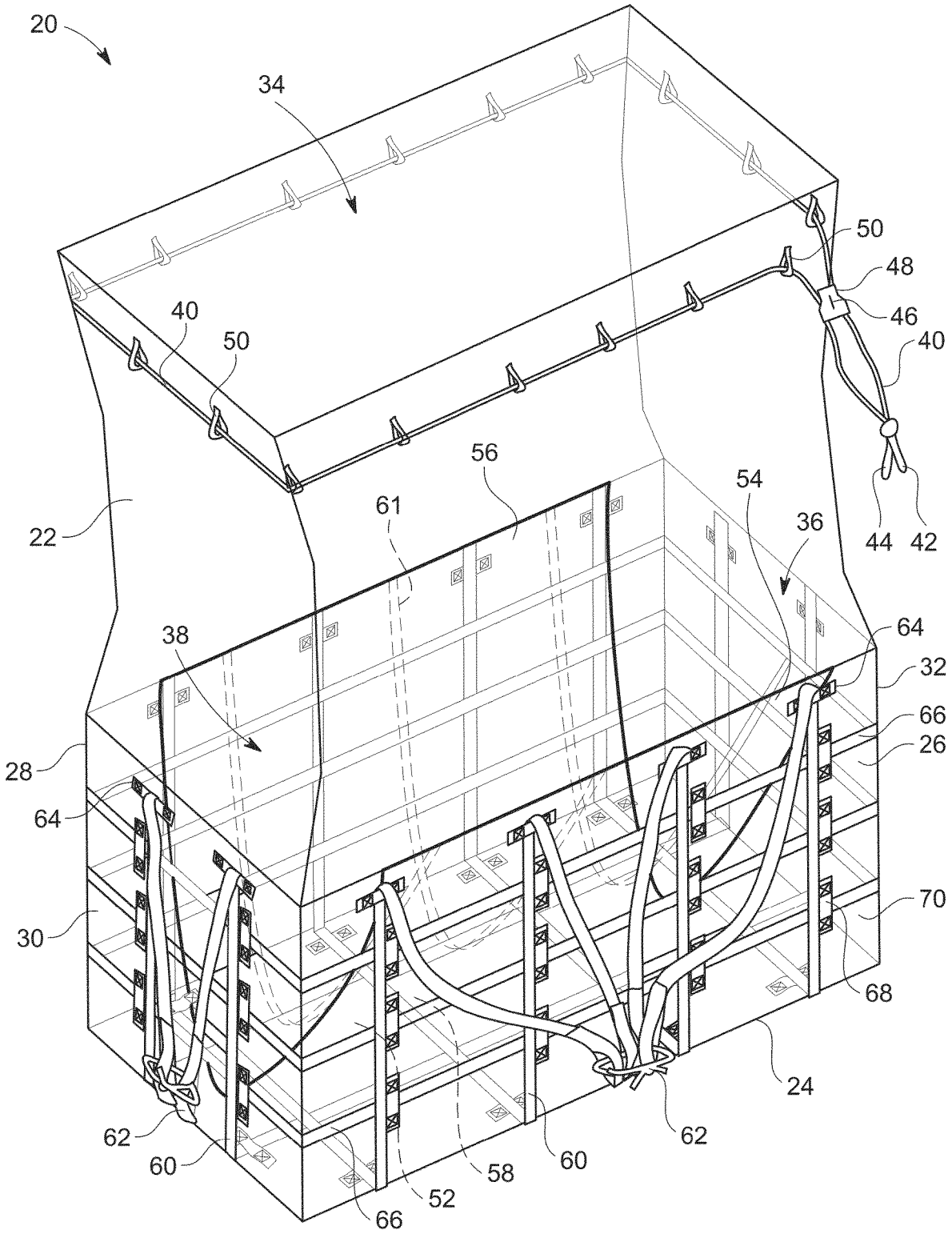
FIG. 1 is a transparent, perspective view of one embodiment of a flexible bulk container.
Figure 2:
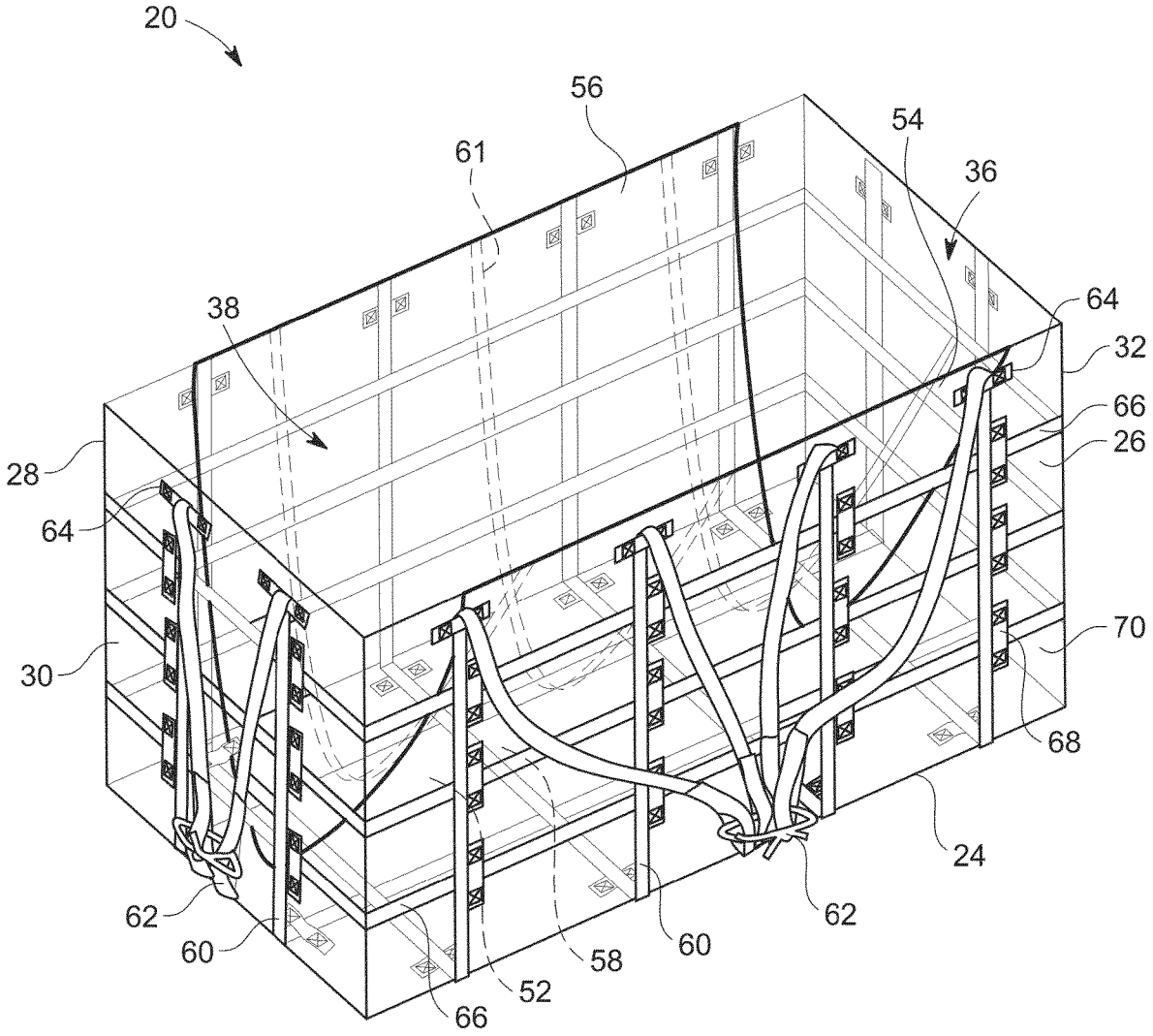
FIG. 2 is a transparent, perspective view of the flexible bulk container in FIG. 1 with the top removed.

FIGS. 1-2 show perspective views of one embodiment of a flexible bulk container 20 (alternatively referred to as a flexible bag) including a top 22 (alternatively referred to as a top side or top wall), a bottom 24 (alternatively referred to as a bottom side or bottom wall), a first side 26, a second side 28, a third side 30, and a fourth side 32 (the sides 26, 28, 30, 32 can alternatively be referred to as sidewalls). The bottom 24 is generally flat and configured to support the flexible bulk container 20 on the ground. It should be noted that the term ground is used to refer to any surface on which the flexible bulk container 20 is positioned and is not limited to natural geologic material such as soil or the like.

The sides 26, 28, 30, 32 of the flexible bulk container 20 extend vertically between the top 22 and the bottom 24 and connect the top 22 and bottom 24 together. The flexible bulk container 20 has a generally rectangular shape with the first side 26 and the second side 28 being positioned opposite each other and the third side 30 and the fourth side 32 being positioned opposite each other.

The flexible bulk container 20 includes an enclosure 36 formed or defined by the top 22, the bottom 24, and the sides 26, 28, 30, 32. The enclosure 36 includes an interior volume 38 configured to receive material.

The top 22 of the flexible bulk container 20 includes an opening 34 through which the interior volume 38 can be filled with material. In some embodiments, the opening 34 is the only opening in the flexible bulk container 20. In other embodiments, the flexible bulk container 20 can include other openings in the bottom 24 and/or the sides 26, 28, 30, 32. It should also be appreciated that the flexible bulk container 20 can include multiple openings in any one of the top 22, the bottom 24, and/or the sides 26, 28, 30, 32.

The opening 34 can have any suitable shape and/or configuration. In some embodiments, the opening 34 can have a shape that at least approximately corresponds to the shape of the flexible bulk container 20. FIG. 1 illustrates such an example where the opening 34 is a rectangular shape that corresponds to the rectangular shape of the flexible bulk container 20. In other embodiments, the opening 34 can have a shape that does not correspond to the shape of the flexible bulk container 20. For example, the opening 34 can be round and the flexible bulk container 20 can be rectangular. Suitable shapes for the opening 34 include rectangular, square, round, oval, triangular, and the like.

Figure 4:
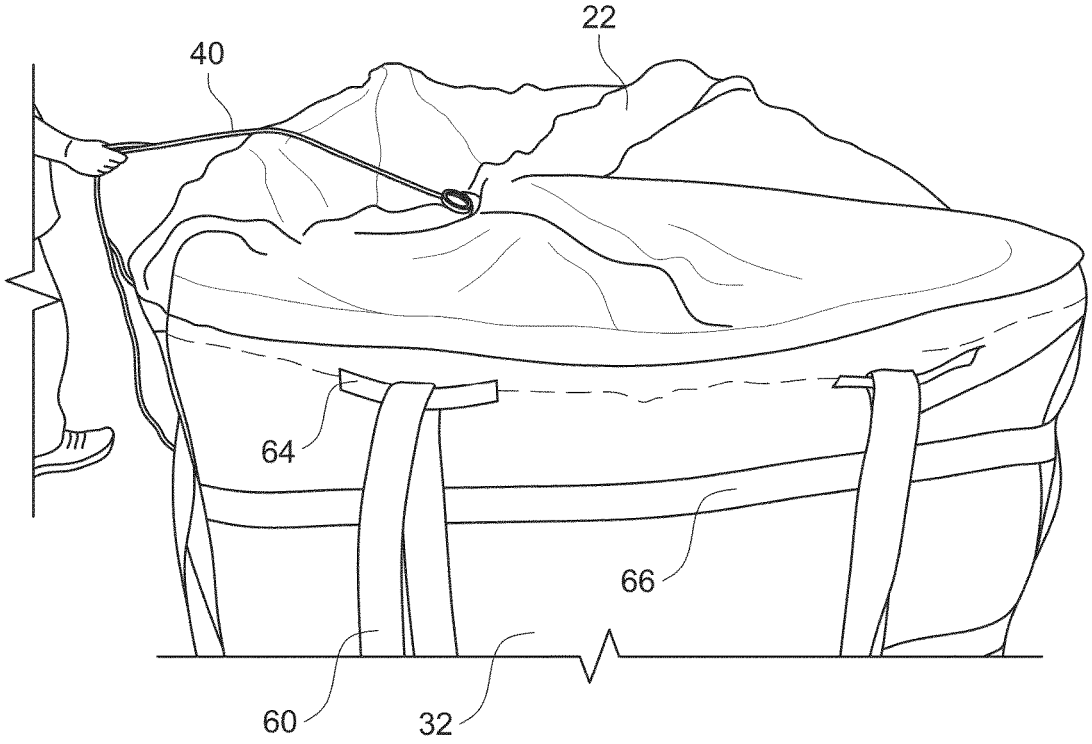
FIG. 4 is a perspective view of the top of the flexible bulk container in FIG. 3.
Figure 5:
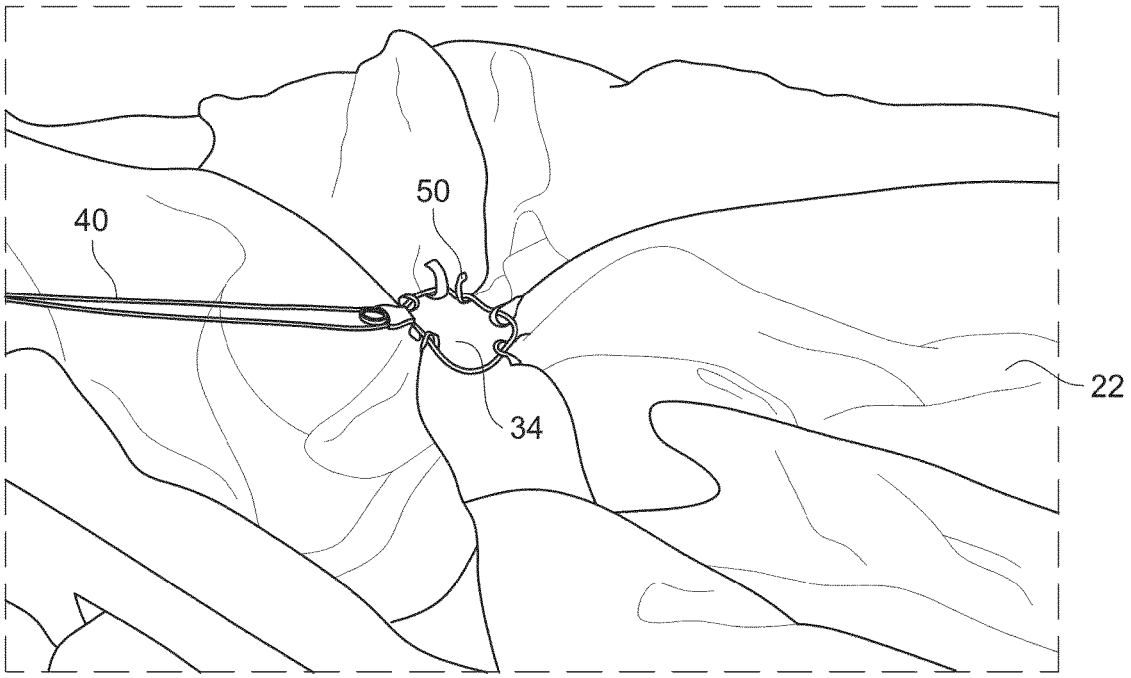
FIG. 5 is a perspective view of an opening in the top of the flexible bulk container in FIG. 3. The opening is closed by a cord extending around the opening.
Figure 6:
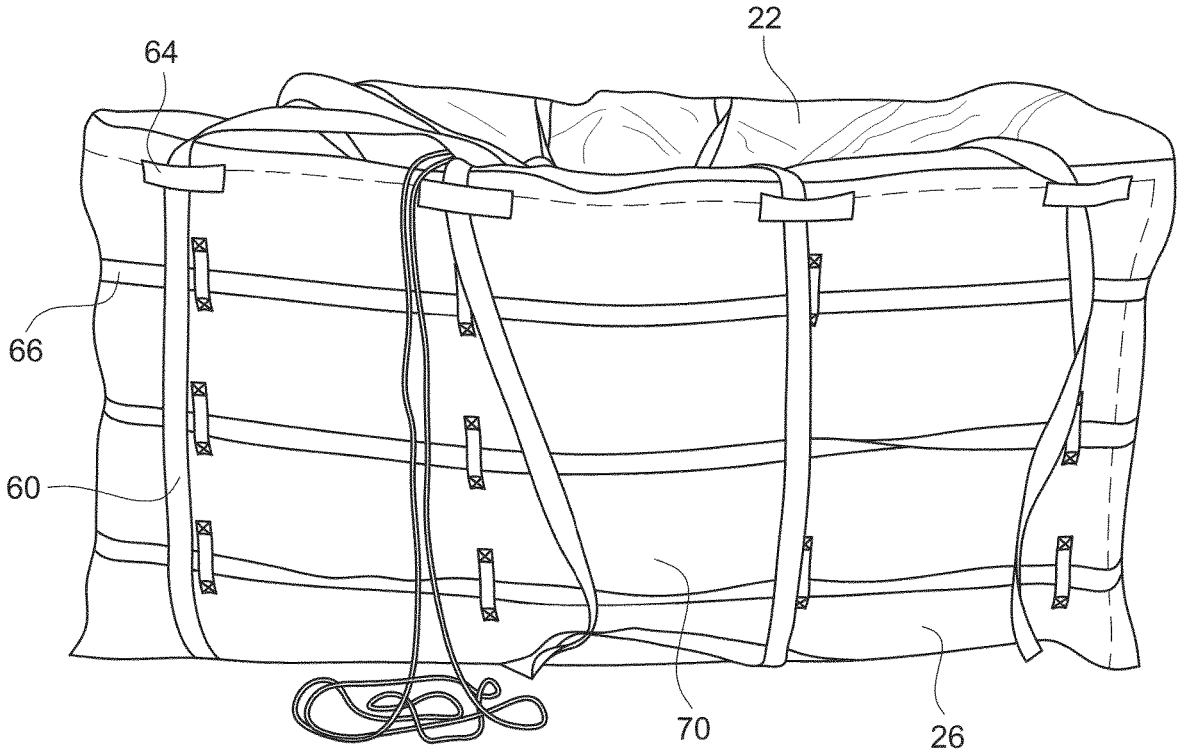
FIGS. 6-7 are side perspective views of the flexible bulk container in FIG. 3.
Figure 7:
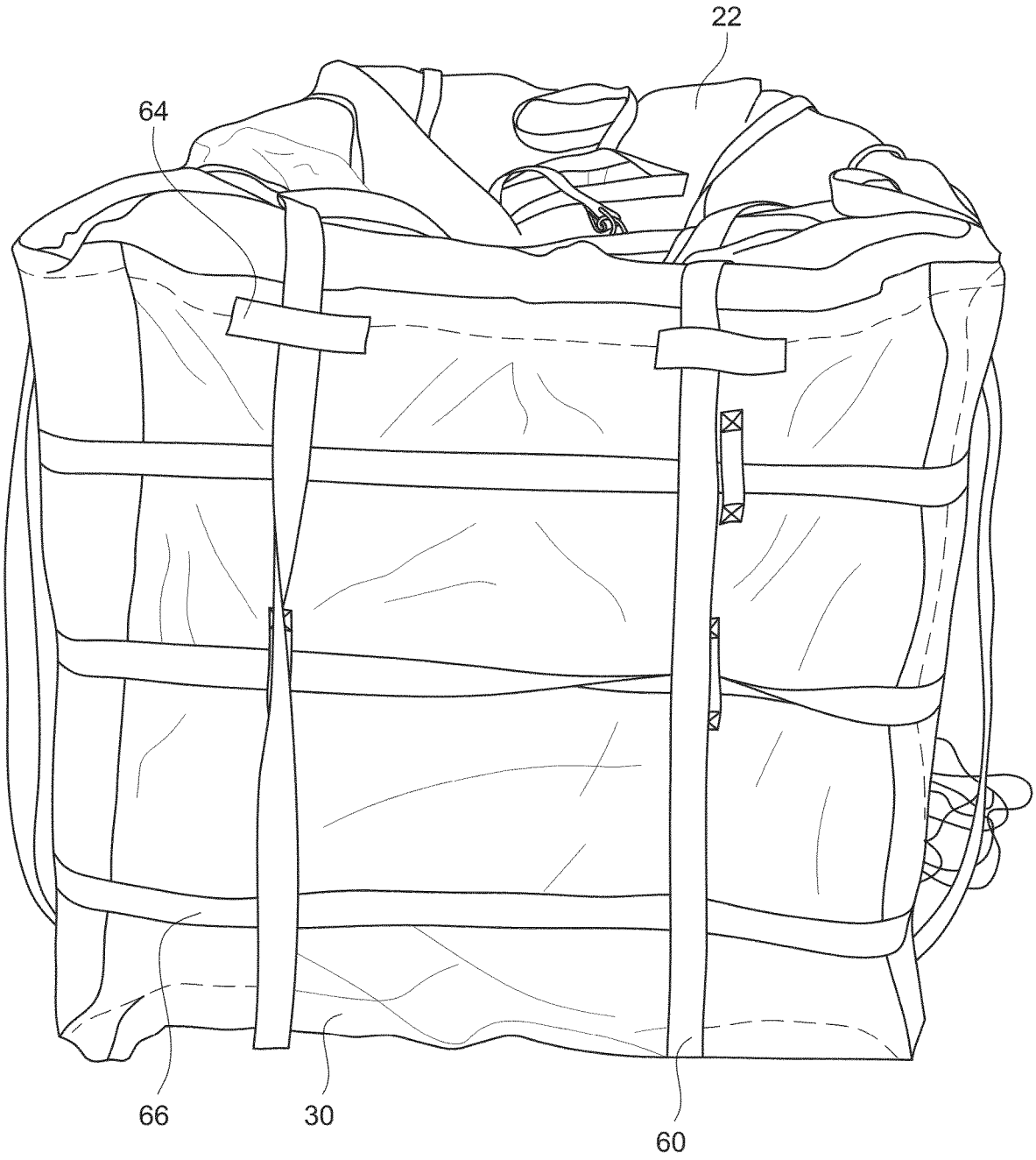

A cord 40 (alternatively referred to as a rope, string, and drawstring) is coupled to the top 22 around a perimeter of the opening 34. The cord 40 can be used to close the opening 34 in the manner shown in FIGS. 4-5). In some embodiments, this can be done by pulling on the cord 40. For example, the cord 40 can operate as a drawstring that closes the opening 34 by pulling on it.

The cord 40 can be held in the closed position by a cord fastener 46 (alternatively referred to as a cordlock). The cord fastener 46 can have any suitable configuration. In some embodiments, opposite ends 42, 44 of the cord 40 extend through the cord fastener 46 and are held in a taught position. For example, the cord fastener 46 can be configured as a one-way tension device that allows the ends 42, 44 of the cord 40 to easily pass through in one direction (the direction that closes the opening 34) but not the opposite direction. The cord fastener 46 can also include a release device 48 that can be activated to allow the cord 40 to move in either direction. In this manner, the cord 40 can be released and the opening 34 can be moved from a closed position to an open position.

The cord 40 can be attached to the top 22 of the flexible bulk container 20 in any suitable manner. In some embodiments, the cord passes through a series of loops 50 coupled to the top 22 around the perimeter of the opening 34. The loops 50 are preferably positioned on the exterior surface of the top 22 adjacent the opening 34. However, it should be appreciated, that the loops 50 can also be positioned on the interior surface of the top adjacent to the opening 34 although such a configuration may not close the opening 34 as effectively.

It should be appreciated that the cord 40 can be coupled to the top 22 in any of a number of suitable ways. For example, the top 22 can include a sleeve extending around the perimeter of the opening 34 through which the cord 40 extends. The sleeve can be positioned on the exterior surface or the interior surface of the top 22 around the perimeter of the opening 34.

It should also be appreciated that the opening 34 can be closed using any suitable fascinating method or device. For example, in some embodiments, the opening 34 can be closed using a zipper, straps, or the like.

In some embodiments, the flexible bulk container 20 can also include an internal flap configured to cover the material before the opening 34 is closed. For example, the flap can be coupled to one of the sides 26, 28, 30, 32 and shaped to roughly correspond to the shape of the flexible bulk container 20. The flap is folded up as the flexible bulk container 20 is filled with material. When the flexible bulk container 20 is full, the flap is folded over the top of the material and the opening 34 is closed above it. The flap forms a barrier between the material and the opening 34 in the top 22.

As shown in FIGS. 1-2, the flexible bulk container 20 can also include a support sling 52 (alternatively referred to as a hammock, saddle, or cradle) positioned in the interior volume 38. The support sling 52 includes a first end 54, a second end 56, and a middle section 58. The first end 54 is coupled to the first side 26 of the flexible bulk container 20 at or adjacent to the top 22, and the second end 56 is coupled to the second side 28 at or adjacent to the top 22. The middle section 58 hangs downward in the interior volume 38.

In some embodiments, the ends 54, 56 are coupled to the sides 26, 28 at a location above the bottom 24 a distance that is at least 60% of the height of the sides 26, 28, respectively. In some embodiments, the ends 54, 56 are coupled to the sides 26, 28 at a location above the bottom 24 a distance that is at least 80% of the height of the sides 26, 28, respectively. In some embodiments, the ends 54, 56 are coupled to the sides 26, 28 at a location above the bottom 24 a distance that is at least 90% of the height of the sides 26, 28, respectively.

The support sling 52 is used to prevent the flexible bulk container 20 from expanding outward as it is filled with material. The weight of the material on the support sling 52 exerts downward and inward forces on the top of the sides 26, 28. These forces maintain the shape of the flexible bulk container 20 both during filling and afterwards when it is transported and/or stored.

The support sling 52 can have a variety of shapes and configurations. In some embodiments, the support sling 52 includes a fabric sheet coupled to the sides 26, 28 with the middle section 58 hanging in the interior volume 38. The fabric sheet can be made of a non-porous or porous sheet of material. The fabric sheet can also be made of the same material or a different material as the flexible bulk container 20. In some embodiments, the fabric sheet can include reinforcing straps 61.

It should also be appreciated that the support sling 52 can be provided as a combination of multiple independent slings combined together to achieve the function of the single support sling 52. For example, the support sling 52 can include two or more individual sling components configured similarly to what is shown in FIGS. 1-2 but as smaller, separate slings extending across the interior volume 38. This can be envisioned as the support sling 52 being divided into smaller independent strips extending across the interior volume 38. Together the smaller slings function in a manner similar to the fabric sheet shown in FIGS. 1-2.

Figure 3:
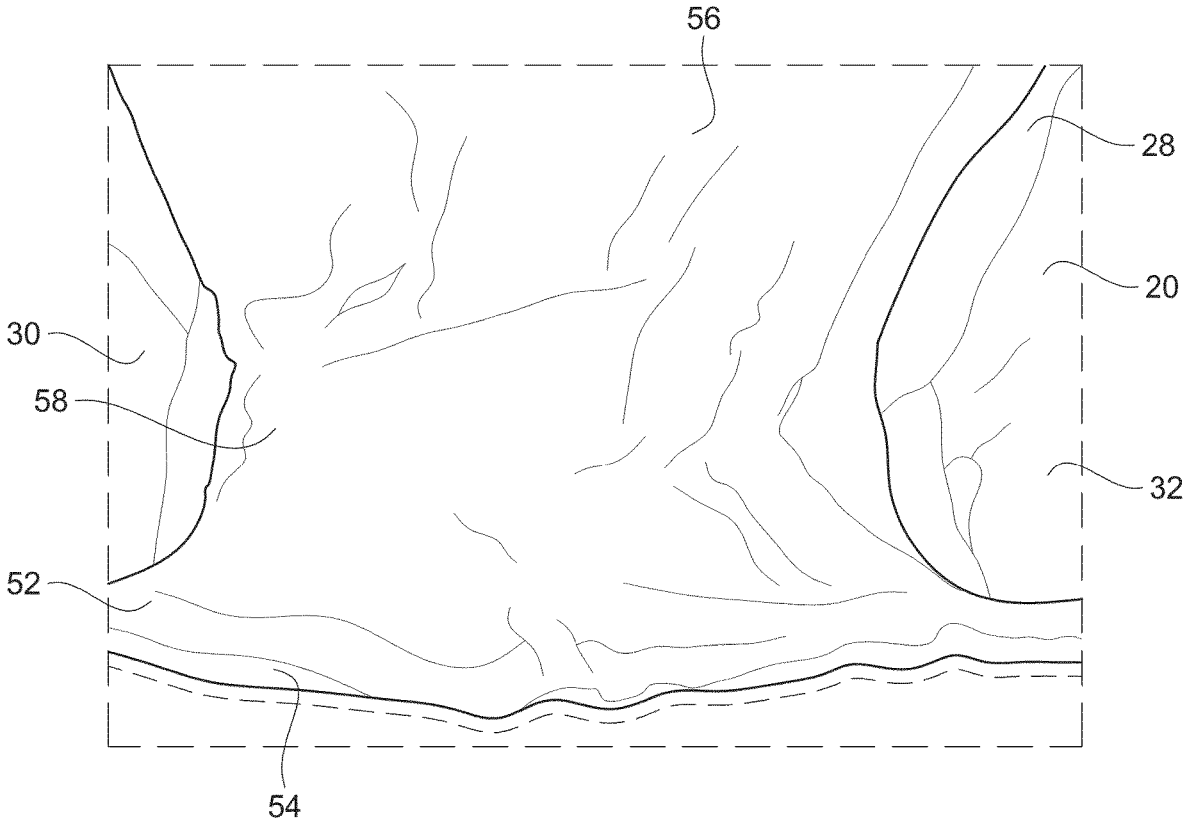
FIG. 3 is a perspective view of one embodiment of a support sling positioned inside another embodiment of a flexible bulk container.

The support sling 52 can also have a variety of sizes. In some embodiments, the support sling 52 is sized so that the middle section 58 does not touch the bottom 24 of the flexible bulk container 20. FIGS. 1-2 show one example of the middle section 58 not touching the bottom 24. In other embodiments, the middle section 58 does contact the bottom 24. FIG. 3 shows one example of the middle section 58 touching the bottom 24.

The support sling 52 can also be configured to take up or span a varying amount of space in the interior volume 38 of the flexible bulk container 20. In some embodiments, the support sling 52 can be configured to span approximately 30% to approximately 100% of a horizontal cross-sectional area of the interior volume 38 of the flexible bulk container 20. In some embodiments, the support sling 52 can be configured to span at least 30% of a horizontal cross-sectional area of the interior volume 38 of the flexible bulk container 20 or at least 50% of a horizontal cross-sectional area of the interior volume 38 of the flexible bulk container 20.

The support sling 52 has a first distance measured from the first end 54 to the second end 56 that is generally shorter than a second distance measured from a first location where the first end 54 is coupled to the first side 26, straight downward along the first side 26 to the bottom 24, across the bottom 24, and straight upward to a second location where the second end 56 is coupled to the second side 28. The difference between the first and second distances is why the support sling 52 hangs downward in the interior volume 38 instead of fully following the sides 26, 28, and the bottom 24. In other words, a center portion of the support sling 52 located in the center of the flexible bulk container 20 is closer to the bottom 24 than the side portions of the support sling 52 located adjacent to the sides 26, 28 of the flexible bulk container 20.

In some embodiments, the first distance is approximately 5% to approximately 30% shorter than the second distance. In some embodiments the first distance is at least approximately 5% shorter than the second distance, at least approximately 10% shorter than the second distance, or at least approximately 15% shorter than the second distance.

The flexible bulk container 20 can also include one or more lifting straps 60 (alternatively referred to as belting or rigging) that can be used to lift the flexible bulk container 20. The lifting straps 60 include a connector 62 configured to extend above the top 22 of the flexible bulk container 20. The connector 62 is configured to be coupled to a corresponding component on a lifting device or lifting equipment—e.g., loader, excavator, crane, forklift, skid steer tractor, or other heavy equipment. In some embodiments, the connector 62 is a loop in the end of the strap material. It should be appreciated, however, that any suitable connecting component can be used to facilitate coupling of the lifting straps 60 to a lifting device.

As shown in FIGS. 1-2, there are four lifting straps 60 extending downward from the top 22 along an exterior surface of the first side 26, horizontally across the bottom 24, and upward along the exterior of the second side 28 back to the top 22. Likewise, there are two lifting straps 60 extending downward from the top 22 along an exterior surface of the third side 30, horizontally across the bottom 24, and upward along the exterior of the fourth side 32 back to the top 22. The lifting straps 60 extending along the sides 26, 28 and the lifting straps 60 extending along the sides 30, 32 cross each other in a generally perpendicular manner on the bottom 24.

In some embodiments, the configuration of the lifting straps 60 can produce a lifting sling capable of being used to lift and maneuver the flexible bulk container 20. The lifting sling can be configured to be easily engaged by a lifting device to lift the flexible bulk container 20.

It should be appreciated that any number and configuration of the lifting straps 60 can be used. For example, the number of lifting straps 60 positioned on each side 26, 28, 30, 32 can vary depending on a number of factors including the length of the sides, the size of the load, the overall shape of the flexible bulk container 20, and the like.

It should also be appreciated that the lifting straps 60 can be made of any suitable material capable of carrying the weight of the flexible bulk container 20 when it is loaded. In some embodiments, the lifting straps 60 can be made of a polymeric material such as a polyamide (nylon), polyester, or the like.

The flexible bulk container 20 can also include strap retainers 64 coupled to the sides 26, 28, 30, 32 adjacent to the top 22 to hold the lifting straps 60 in position. In some embodiments, the strap retainers 64 are fixed to the lifting straps 60 and/or the sides 26, 28, 30, 32. In this configuration, the strap retainers 64 prevent lengthwise and side to side movement of the lifting straps 60 relative to the sides 26, 28, 30, 32 and/or the strap retainers 64. In other embodiments, the strap retainers 64 are not fixed to the lifting straps 60. In this configuration the lifting straps 60 can move lengthwise relative to the sides 26, 28, 30, 32 and/or the strap retainers 64. However, the strap retainers 64 prevent side to side movement of the lifting straps 60.

The flexible bulk container 20 can also include support straps 66 extending horizontally around an outer perimeter of the sides 26, 28, 30, 32. The support straps 66 can be provided to preserve the shape of the flexible bulk container 20 as it is loaded with material. The support straps 66 serve to prevent the sides 26, 28, 30, 32 from expanding too far outward.

The support straps 66 can be held in place on the sides 26, 28, 30, 32 by strap retainers 68. The strap retainers 68 can be configured similarly to the strap retainers 64. For example, the strap retainers 68 can be fixed to both the support straps 66 and the sides 26, 28, 30, 32 or just to the sides 26, 28, 30, 32. In the former configuration, the support straps 66 are held in a fixed position and cannot move. In the latter configuration, the support straps 66 can move lengthwise relative to the strap retainers 68 and/or the sides 26, 28, 30, 32.

The flexible bulk container 20 can be self standing or non self standing. In the self standing embodiments, the sides 26, 28, 30, 32 and/or bottom 24 can be configured to include rigid panels 70 that hold the flexible bulk container 20 upright. The rigid panels 70 is generally coupled to the flexible fabric used to form the flexible bulk container 20.

The rigid panels 70 can be incorporated into the flexible bulk container 20 in a variety of ways. In some embodiments, the rigid panels 70 can be attached to an interior or exterior surface of the flexible fabric that forms the sides 26, 28, 30, 32 and/or the bottom 24. In other embodiments, the rigid panels 70 can be positioned inside two layers of the flexible fabric that forms the sides 26, 28, 30, 32 and/or the bottom 24.

The rigid panels 70 can be made of any suitable material. In general, it is preferable for the rigid panels 70 to be lightweight and inexpensive. Examples of materials that can be used to make the rigid panels 70 include cardboard, fiber board, and the like. It should be appreciated, that each side 26, 28, 30, 32 and/or bottom 24 can include one or more rigid panels 70.

The flexible bulk container 20 can have any suitable size. In some embodiments, the interior volume 38 can be approximately 1 cubic yard to approximately 10 cubic yards, approximately 2 cubic yards to approximately 9 cubic yards, approximately 3 cubic yards to approximately 8 cubic yards, or approximately 4 cubic yards to approximately 6 cubic yards. In some embodiments, the interior volume 38 can be at least approximately 1 cubic yard, at least approximately 2 cubic yards, at least approximately 3 cubic yards, at least approximately 4 cubic yards, or at least approximately 4.5 cubic yards. In some embodiments, the interior volume 38 can be no more than approximately 10 cubic yards, no more than approximately 9 cubic yards, no more than approximately 8 cubic yards, or no more than approximately 6 cubic yards.

The flexible bulk container 20 can have any suitable dimensions. In some embodiments, the flexible bulk container 20 can have a height of approximately 24 inches to approximately 96 inches, a height of approximately 30 inches to approximately 90 inches, or a height of approximately 36 inches to approximately 84 inches. In some embodiments, the flexible bulk container 20 has a height of at least approximately 24 inches, at least approximately 30 inches, or at least approximately 36 inches.

The flexible bulk container 20 can also have any suitable shape. In some embodiments, the flexible bulk container 20 has a rectangular shape, which includes a square shape. In some embodiments, the flexible bulk container 20 can be round, oval, triangular, or have any other suitable shape.

The flexible bulk container 20 can also be watertight or at least the sides 26, 28, 30, 32 and bottom 24 can be configured to be watertight. In some embodiments, a liner made of a polymer material such as polyethylene, polypropylene, or the like, can be positioned in the interior volume 38 to make the sides 26, 28, 30, 32 and bottom 24 water resistant, watertight, or waterproof. The liner can be any suitable thickness such as approximately 2 mil to approximately 15 mil.

The flexible bulk container 20 can also be made of any suitable materials. In some embodiments the flexible fabric used to make be flexible bulk container 20 can be a heavy duty, woven or nonwoven polymeric material. Examples of suitable polymeric materials include polyolefins such as polypropylene and polyethylene as well as polyester and the like.

In some embodiments, the flexible fabric can be made of multiple layers of material. The flexible fabric can also be coated or uncoated. For example, the flexible fabric may include a coating provided to make the flexible bulk container 20 resistant to damage from ultraviolet light and/or weather.

The flexible bulk container 20 can be configured to hold a variety of material. In some embodiments, the flexible bulk container 20 is configured to hold radiological materials includes, but not limited to, radioactive waste such as Class A radioactive waste, low level radioactive waste, and/or very low-level radioactive waste. In some embodiments, the flexible bulk container 20 is qualifies as Type IP-1 packaging or UN rated X for packaging groups I, II, and III. In some environments, the flexible bulk container can meet the waste acceptance criteria of most disposal sites including the U.S. Department of Energy's Nevada Test Site.

The flexible bulk container 20 can be used to package flowable solids, hazardous waste, and as an overpack for other materials. In some embodiments, the flexible bulk container 20 can be used to package hazardous waste including hazardous household waste, lab packing, contaminated PPE, asbestos, dusts, wastewater treatment sludges, contaminated soil (wet or dry), debris including demolition debris, metal, metal containers, gravel, concrete rubble, and the like.

The flexible bulk container 20 can be filled with material in any of a number of ways. In some embodiments, the flexible bulk container 20 is positioned upright with the top 22 open. For example, the top 22 can be folded around the exterior of the sides 26, 28, 30, 32. The material is loaded into the center of the flexible bulk container 20 to avoid pushing out the sides 26, 28, 30, 32 too fast. It can be filled with any suitable equipment including a skid steer, excavator, loader, or the like. In some embodiments, the flexible bulk container 20 can be filled to the top 22 or, preferably, only approximately ½ to ¾ of the way full. After filling the flexible bulk container 20 with material, the opening in the top 22 is closed using the cord 40.

ILLUSTRATIVE EMBODIMENTS

The following is a description of various embodiments of the disclosed subject matter. Each embodiment may include one or more of the various features, characteristics, or advantages of the disclosed subject matter. The embodiments are intended to illustrate a few aspects of the disclosed subject matter and should not be considered a comprehensive or exhaustive description of all possible embodiments.

P1. A flexible bulk container comprising: an enclosure formed by a flexible fabric and defining an interior volume configured to receive material, the enclosure comprising: a top; a bottom positioned opposite the top; and one or more sides extending vertically between the top and the bottom, the one or more sides including a first side positioned opposite a second side; a support sling positioned in the enclosure, the support sling comprising: a first end coupled to the first side of the enclosure at or adjacent to the top of the enclosure; a second end positioned opposite the first end, the second end being coupled to the second side of the enclosure at or adjacent to the top of the enclosure; and a middle section hanging downward in the interior volume.

P2. The flexible bulk container of paragraph P1 comprising an opening in the top of the enclosure.

P3. The flexible bulk container of paragraph P2 wherein the opening in the top is the only opening in the enclosure.

P4. The flexible bulk container of any one of paragraphs P2-P3 wherein the opening is sized to allow the top to fold down over the exterior of the one or more sides.

P5. The flexible bulk container of any one of paragraphs P2-P4 comprising a cord coupled to the top around the opening, the cord being configured to close the opening.

P6. The flexible bulk container of paragraph P5 wherein the cord includes opposite ends each of which extends through a cord fastener configured to hold the cord in a closed position.

P7. The flexible bulk container of any one of paragraphs P5-P6 comprising loops attached to the top around an exterior perimeter of the opening, the cord extending through the loops.

P8. The flexible bulk container of any one of paragraphs P1-P7 wherein the enclosure does not include any openings in the bottom or any of the one or more sides.

P9. The flexible bulk container of any one of paragraphs P1-P8 comprising one or more rigid panels coupled to the one or more side walls to facilitate holding the enclosure open in a self-standing configuration.

P10. The flexible bulk container of any one of paragraphs P1-P9 comprising one or more rigid panels positioned in the bottom of the enclosure to facilitate holding the enclosure open in a self-standing configuration.

P11. The flexible bulk container of any one of paragraphs P1-P10 wherein the middle section of the support sling contacts the bottom of the enclosure.

P12. The flexible bulk container of any one of paragraphs P1-P11 wherein the support sling spans at least 50% of a horizontal, cross-sectional area of the interior volume of the enclosure.

P13. The flexible bulk container of any one of paragraphs P1-P12 wherein the support sling spans at least 70% of a horizontal, cross-sectional area of the interior volume of the enclosure.

P14. The flexible bulk container of any one of paragraphs P1-P13 wherein the support sling is made of the same flexible fabric as the enclosure.

P15. The flexible bulk container of any one of paragraphs P1-P14 wherein the first end and the second end of the support sling are coupled to the first side and the second side of the enclosure at a location above the bottom a distance that is at least 60% of the height of the first side and the second side, respectively.

P16. The flexible bulk container of any one of paragraphs P1-P15 wherein the first end and the second end of the support sling are coupled to the first side and the second side of the enclosure at a location above the bottom a distance that is at least 80% of the height of the first side and the second side, respectively.

P17. The flexible bulk container of any one of paragraphs P1-P16 wherein the first end and the second end of the support sling are coupled to the first side and the second side of the enclosure at a location above the bottom a distance that is at least 90% of the height of the first side and the second side, respectively.

P18. The flexible bulk container of any one of paragraphs P1-P17 wherein a first distance along the support sling from a first location where the first end is coupled to the first side to a second location where the second end is coupled to the second side is shorter than a second distance from the first location straight downward to the bottom, across the bottom, and straight upward to the second location.

P19. The flexible bulk container of paragraph P18 wherein the first distance is at least 5% shorter than the second distance.

P20. The flexible bulk container of any one of paragraphs P18-P19 wherein the first distance is at least 10% shorter than the second distance.

P21. The flexible bulk container of any one of paragraphs P1-P20 wherein the flexible bulk container has a rectangular shape.

P22. The flexible bulk container of any one of paragraphs P1-P21 comprising a lifting sling formed by lifting straps each of which extends down from the top of the enclosure along one of the one or more sides, across the bottom, and up along another one of the one or more sides to the top.

P23. The flexible bulk container of any one of paragraphs P1-P22 comprising lifting straps extending down from the top of the enclosure along one of the one or more sides, across the bottom, and up along another one of the one or more sides to the top.

P24. The flexible bulk container of paragraph P23 wherein the lifting straps include at least two lifting straps extending down from the top of the enclosure along the first side, across the bottom, and up along the second side to the top.

P25 The flexible bulk container of paragraph P24 wherein the one or more sides include a third side and a fourth side positioned opposite the third side, and wherein the lifting straps include at least two lifting straps extending down from the top of the enclosure along the third side, across the bottom, and up along the fourth side to the top.

P26. The flexible bulk container of paragraph P25 wherein the lifting straps extending along the first side and the second side cross and are perpendicular to the lifting straps extending along the third side and the fourth side across the bottom.

P27. The flexible bulk container of any one of paragraphs P23-P26 comprising strap retainers positioned on the one or more sides at or adjacent to the top of the enclosure, the strap retainers being configured to allow lengthwise movement of the lifting straps and prevent side to side movement of the lifting straps.

P28. The flexible bulk container of any one of paragraphs P1-P27 comprising one or more support straps extending horizontally around an outer perimeter of the one or more sides of the enclosure.

P29. The flexible bulk container of paragraph P28 comprising strap retainers positioned on the one or more sides, the strap retainers being configured to allow lengthwise movement of the lifting straps and prevent side to side movement of the lifting straps.

P30. The flexible bulk container of any one of paragraphs P1-P29 wherein the bottom is flat.

P31. The flexible bulk container of any one of paragraphs P1-P30 wherein the flexible bulk container has a rectangular shape.

P32. The flexible bulk container of any one of paragraphs P1-P31 wherein the flexible bulk container is self-standing.

P33. The flexible bulk container of any one of paragraphs P1-P32 wherein the interior volume is at least 2 cubic yards.

P34. The flexible bulk container of any one of paragraphs P1-P33 wherein the interior volume is at least 4 cubic yards.

P35. A flexible bulk container comprising: a top including an opening through which the flexible bulk container can be filled with material; a bottom positioned opposite the top, the bottom being configured to rest on the ground and support the flexible bulk container; one or more sides extending vertically between the top and the bottom; an interior volume defined by the top, the bottom, and the one or more sides, the interior volume being configured to receive and hold the material; and a fabric sheet coupled to opposite sides of the one or more sides at or adjacent to the top of the flexible bulk container, the fabric sheet hanging in the interior volume.

P36. The flexible bulk container of paragraph P35 wherein the opening in the top is the only opening in the flexible bulk container.

P37. The flexible bulk container of any one of paragraphs P35-P36 wherein the opening is sized to allow the top to fold down over the exterior of the one or more sides.

P38. The flexible bulk container of any one of paragraphs P35-P37 comprising a cord coupled to the top around the opening, the cord being configured to close the opening.

P39. The flexible bulk container of any one of paragraphs P35-P38 wherein the bottom and the one or more sides do not include any openings into the flexible bulk container.

P40. The flexible bulk container of any one of paragraphs P35-P39 wherein the flexible bulk container is self-standing.

P41. A flexible bulk container comprising: an enclosure formed by a flexible fabric and defining an interior volume configured to receive material, the enclosure comprising: a top; a bottom positioned opposite the top; and one or more sides extending vertically between the top and the bottom; an opening in the top of the enclosure through which the flexible bulk container can be filled with the material; and a cord coupled to the top around the opening; wherein the opening is the only opening in the flexible bulk container; and wherein the cord operates as a drawstring to close the opening.

P42. The flexible bulk container of paragraph P41 wherein the opening in the top is the only opening in the flexible bulk container.

P43. The flexible bulk container of any one of paragraphs P41-P42 wherein the cord includes opposite ends each of which extends through a cord fastener configured to hold the cord in a closed position.

P44. The flexible bulk container of any one of paragraphs P41-P43 comprising loops attached to the top around an exterior perimeter of the opening, the cord extending through the loops.

P45. The flexible bulk container of any one of paragraphs P41-P44 wherein the flexible bulk container has a rectangular shape.

P46. A flexible bulk container comprising: a top including an opening through which the flexible bulk container can be filled with material; a bottom positioned opposite the top, the bottom being configured to rest on the ground and support the flexible bulk container; one or more sides extending vertically between the top and the bottom; an interior volume defined by the top, the bottom, and the one or more sides, the interior volume being configured to receive and hold the material; and a cord coupled to the top around the opening; wherein the opening is movable from an open position to a closed position by pulling the cord and contracting the opening; and wherein the opening in the top is the only opening in the flexible bulk container;

P47. The flexible bulk container of paragraph P46 wherein the cord includes opposite ends each of which extends through a cord fastener configured to hold the cord in a closed position.

P48. The flexible bulk container of any one of paragraphs P46-P47 comprising loops attached to the top around an exterior perimeter of the opening, the cord extending through the loops.

General Terminology and Interpretative Conventions

Any methods described in the claims or specification should not be interpreted to require the steps to be performed in a specific order unless expressly stated otherwise. Also, the methods should be interpreted to provide support to perform the recited steps in any order unless expressly stated otherwise.

Certain features described in the context of separate embodiments can also be implemented in combination in a single embodiment. Conversely, various features that are described in the context of a single embodiment can also be implemented in multiple embodiments separately or in any suitable subcombination. Moreover, although features may be described above in certain combinations and even initially claimed as such, one or more features from a claimed combination can be excised from the combination, and the claimed combination may be directed to a subcombination or variation of a subcombination.

The example configurations described in this document do not represent all the examples that may be implemented or that are within the scope of the claims. The term "example" shall be interpreted to mean "serving as an example, instance, or illustration," and not "preferred" or "advantageous over other examples."

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all the items together, or any combination or number of the items.

The phrase "based on" shall be interpreted to refer to an open set of conditions unless unequivocally stated otherwise (e.g., based on only a given condition). For example, a step described as being based on a given condition may be based on the recited condition and one or more unrecited conditions.

The terms have, having, contain, containing, include, including, and characterized by should be interpreted to be synonymous with the terms comprise and comprising—i.e., the terms are inclusive or open-ended and do not exclude additional unrecited subject matter. The use of these terms should also be understood as disclosing and providing support for narrower alternative embodiments where these terms are replaced by "consisting of" or "consisting essentially of."

Unless otherwise indicated, all numbers or expressions, such as those expressing dimensions, physical characteristics, and the like, used in the specification (other than the claims) are understood to be modified in all instances by the term "approximately." At the very least, and not as an attempt to limit the application of the doctrine of equivalents to the claims, each numerical parameter recited in the specification or claims which is modified by the term "approximately" should be construed in light of the number of recited significant digits and by applying ordinary rounding techniques.

All disclosed ranges are to be understood to encompass and provide support for claims that recite any subranges or any individual values subsumed by each range. For example, a stated range of 1 to 10 should be considered to include and provide support for claims that recite any subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth), which values can be expressed alone or as a minimum value (e.g., at least 5.8) or a maximum value (e.g., no more than 9.9994).

All disclosed numerical values are to be understood as being variable from 0-100% in either direction and thus provide support for claims that recite such values (either alone or as a minimum or a maximum—e.g., at least <value> or no more than <value>) or any ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range expressed individually (e.g., 15.2), as a minimum value (e.g., at least 4.3), or as a maximum value (e.g., no more than 12.4).

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used in this document shall mean" or similar language (e.g., "this term means," "this term is defined as," "for the purposes of this disclosure this term shall mean," etc.). References to specific examples, use of "i.e.," use of the word "invention," etc., are not meant to invoke exception (b) or otherwise restrict the scope of the recited claim terms. Other than situations where exception (b) applies, nothing contained in this document should be considered a disclaimer or disavowal of claim scope.

The subject matter recited in the claims is not coextensive with and should not be interpreted to be coextensive with any embodiment, feature, or combination of features described or illustrated in this document. This is true even if only a single embodiment of the feature or combination of features is illustrated and described.

Joining or Fastening Terminology and Interpretative Conventions

The term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The term "coupled" includes joining that is permanent in nature or releasable and/or removable in nature. Permanent joining refers to joining the components together in a manner that is not capable of being reversed or returned to the original condition. Releasable joining refers to joining the components together in a manner that is capable of being reversed or returned to the original condition.

Releasable joining can be further categorized based on the difficulty of releasing the components and/or whether the components are released as part of their ordinary operation and/or use. Readily or easily releasable joining refers to joining that can be readily, easily, and/or promptly released with little or no difficulty or effort. Difficult or hard to release joining refers to joining that is difficult, hard, or arduous to release and/or requires substantial effort to release. The joining can be released or intended to be released as part of the ordinary operation and/or use of the components or only in extraordinary situations and/or circumstances. In the latter case, the joining can be intended to remain joined for a long, indefinite period until the extraordinary circumstances arise.

It should be appreciated that the components can be joined together using any type of fastening method and/or fastener. The fastening method refers to the way the components are joined. A fastener is generally a separate component used in a mechanical fastening method to mechanically join the components together. A list of examples of fastening methods and/or fasteners are given below. The list is divided according to whether the fastening method and/or fastener is generally permanent, readily released, or difficult to release.

Examples of permanent fastening methods include welding, soldering, brazing, crimping, riveting, stapling, stitching, some types of nailing, some types of adhering, and some types of cementing. Examples of permanent fasteners include some types of nails, some types of dowel pins, most types of rivets, most types of staples, stitches, most types of structural ties, and toggle bolts.

Examples of readily releasable fastening methods include clamping, pinning, clipping, latching, clasping, buttoning, zipping, buckling, and tying. Examples of readily releasable fasteners include snap fasteners, retainer rings, circlips, split pin, linchpins, R-pins, clevis fasteners, cotter pins, latches, hook and loop fasteners (VELCRO), hook and eye fasteners, push pins, clips, clasps, clamps, zip ties, zippers, buttons, buckles, split pin fasteners, and/or conformat fasteners.

Examples of difficult to release fastening methods include bolting, screwing, most types of threaded fastening, and some types of nailing. Examples of difficult to release fasteners include bolts, screws, most types of threaded fasteners, some types of nails, some types of dowel pins, a few types of rivets, a few types of structural ties.

It should be appreciated that the fastening methods and fasteners are categorized above based on their most common configurations and/or applications. The fastening methods and fasteners can fall into other categories or multiple categories depending on their specific configurations and/or applications. For example, rope, string, wire, cable, chain, and the like can be permanent, readily releasable, or difficult to release depending on the application.

Drawing Related Terminology and Interpretative Conventions

Reference numbers in the drawings and corresponding description refer to identical or similar elements although such numbers may be referenced in the context of different embodiments.

The drawings are intended to illustrate embodiments that are both drawn to scale and/or not drawn to scale. This means the drawings can be interpreted, for example, as showing: (a) everything drawn to scale, (b) nothing drawn to scale, or (c) one or more features drawn to scale and one or more features not drawn to scale. Accordingly, the drawings can serve to provide support to recite the sizes, proportions, and/or other dimensions of any of the illustrated features either alone or relative to each other. Furthermore, all such sizes, proportions, and/or other dimensions are to be understood as being variable from 0-100% in either direction and thus provide support for claims that recite such values or any ranges or subranges that can be formed by such values.

Spatial or directional terms, such as "left," "right," "front," "back," and the like, relate to the subject matter as it is shown in the drawings and/or how it is commonly oriented during manufacture, use, or the like. However, it is to be understood that the described subject matter may assume various alternative orientations and, accordingly, such terms are not to be considered as limiting.

The invention claimed is:

1. A flexible bulk container comprising:

an enclosure formed by a flexible fabric and defining an interior volume configured to receive material, the enclosure comprising:

a top including an opening sized to receive the material;

a bottom positioned opposite the top; and one or more sides extending vertically between the top and the bottom, the one or more sides including a first side positioned opposite a second side;

a support sling positioned in the enclosure, the support sling comprising:

a first end coupled to the first side of the enclosure at or adjacent to the top of the enclosure;

a second end positioned opposite the first end, the second end being coupled to the second side of the enclosure at or adjacent to the top of the enclosure; and a middle section hanging downward in the interior volume;

wherein a first distance along the support sling from a first location where the first end is coupled to the first side to a second location where the second end is coupled to the second side is shorter than a second distance from the first location straight downward to the bottom, across the bottom, and straight upward to the second location; and wherein the support sling is shaped to use the weight of the material received in the enclosure to maintain the shape of the opening and/or overall shape of the flexible bulk container.

2. The flexible bulk container of claim 1 wherein the opening in the top of the enclosure is the only opening in the enclosure.

3. The flexible bulk container of claim 1 comprising one or more rigid panels coupled to the one or more sides to facilitate holding the enclosure open in a self-standing configuration.

4. The flexible bulk container of claim 1 wherein the first end and the second end of the support sling are coupled to the first side and the second side of the enclosure at a location above the bottom a distance that is at least 60% of the height of the first side and the second side, respectively.

5. The flexible bulk container of claim 1 wherein the first distance is at least 10% shorter than the second distance.

6. The flexible bulk container of claim 1 comprising a lifting sling formed by lifting straps each of which extends down from the top of the enclosure along one of the one or more sides, across the bottom, and up along another one of the one or more sides to the top.

7. A flexible bulk container comprising:

a top including an opening through which the flexible bulk container can be filled with material;

a bottom positioned opposite the top, the bottom being configured to rest on the ground and support the flexible bulk container;

one or more sides extending vertically between the top and the bottom;

an interior volume defined by the top, the bottom, and the one or more sides, the interior volume being configured to receive and hold the material; and a fabric sheet coupled to opposite sides of the one or more sides at or adjacent to the top of the flexible bulk container, the fabric sheet hanging in the interior volume;

wherein a center portion of the fabric sheet located in a center of the flexible bulk container is closer to the bottom than a side portion of the fabric sheet located adjacent to the one or more sides of the flexible bulk container; and wherein the fabric sheet is shaped to use the weight of the material to maintain the shape of the opening and/or the overall shape of the flexible bulk container.

8. The flexible bulk container of claim 7 wherein the opening in the top is the only opening in the flexible bulk container.

9. The flexible bulk container of claim 7 wherein the opening is sized to allow the top to fold down over an exterior of the one or more sides.

10. The flexible bulk container of claim 7 comprising a cord coupled to the top around the opening, the cord being configured to close the opening.

11. The flexible bulk container of claim 7 wherein the bottom and the one or more sides do not include any openings into the flexible bulk container.

12. The flexible bulk container of claim 7 wherein the flexible bulk container is self-standing.

13. The flexible bulk container of claim 7 wherein the fabric sheet spans above at least 50% of a horizontal, cross-sectional area of the interior volume.

14. The flexible bulk container of claim 7 wherein the interior volume is at least 2 cubic yards.

15. The flexible bulk container of claim 1 comprising a cord coupled to the top around the opening, the cord being configured to close the opening.

16. The flexible bulk container of claim 1 wherein the support sling spans above at least 50% of a horizontal, cross-sectional area of the interior volume of the enclosure.

17. The flexible bulk container of claim 1 wherein the flexible bulk container has a rectangular shape.

18. The flexible bulk container of claim 1 wherein the interior volume is at least 2 cubic yards.

19. The flexible bulk container of claim 1 comprising lifting straps extending down from the top of the enclosure along one of the one or more sides, across the bottom, and up along another one of the one or more sides to the top.

20. The flexible bulk container of claim 19 comprising strap retainers positioned on the one or more sides at or adjacent to the top of the enclosure, the strap retainers being configured to allow lengthwise movement of the lifting straps and prevent side to side movement of the lifting straps.

* * * * *